United States Patent [19]

Fisher et al.

[11] 3,948,183

[45] Apr. 6, 1976

[54] FLUIDIC CAPACITANCE DEVICE

[75] Inventors: Evan D. Fisher, Chevy Chase; Carl J. Campagnuolo, Potomac; Stacy E. Gehman, Takoma Park, all of Md.

[73] Assignee: The United States of America as represented by the Secretary of the Army, Washington, D.C.

[22] Filed: Nov. 25, 1974

[21] Appl. No.: 527,177

[52] U.S. Cl. ..... 102/70.2 P

[51] Int. Cl.[2] ..... F42C 13/00

[58] Field of Search ..... 102/70.2 G, 70.2 P, 70.2 R; 343/7 PF

[56] References Cited

UNITED STATES PATENTS

| | | | |
|---|---|---|---|
| 2,403,567 | 7/1946 | Wales, Jr. | 102/70.2 P |
| 2,969,736 | 1/1961 | Bergvall | 102/70.2 P |
| 3,772,541 | 11/1973 | Campagnuolo et al. | 102/70.2 G |
| 3,792,664 | 2/1974 | Campagnuolo | 102/70.2 G |
| 3,871,296 | 3/1975 | Heilprin et al. | 102/70.2 P |
| 3,877,382 | 4/1975 | Kalmus | 102/70.2 P |
| 3,882,781 | 5/1975 | Krupen | 102/70.2 P |
| 3,889,599 | 6/1975 | Apstein | 102/70.2 P |

*Primary Examiner*—Charles T. Jordan

*Attorney, Agent, or Firm*—Nathan Edelberg; Robert P. Gibson; Saul Elbaum

[57] ABSTRACT

The transmitter for an A.C. capacitance proximity fuze consists of an A.C. generator whose output is directly connected to the transmitter probes of an A.C. capacitance fuze. The A.C. generator may be either a wind driven alternator or a fluid oscillator power supply driven by the ram pressure of the air. This arrangement eliminates the need for a separate oscillator as the power supply is now also the transmitter.

10 Claims, 4 Drawing Figures

FIG. 1
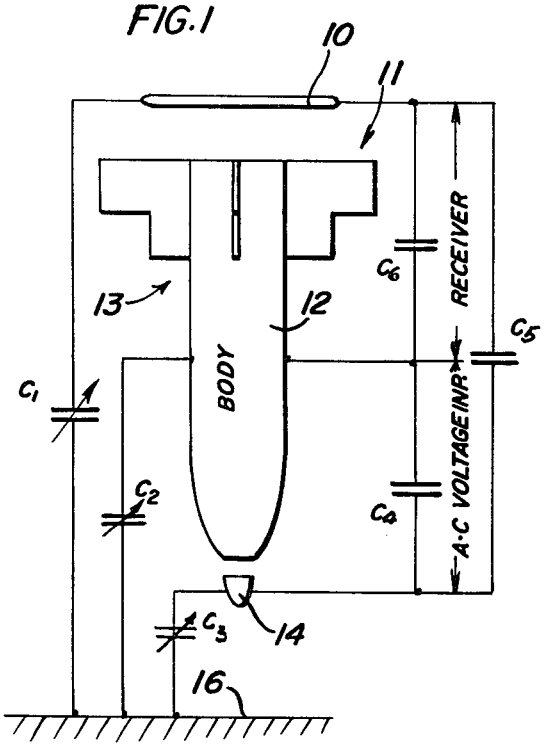
FIG. 1A
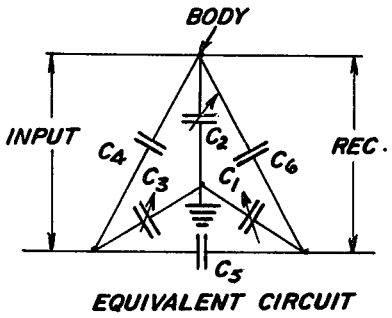
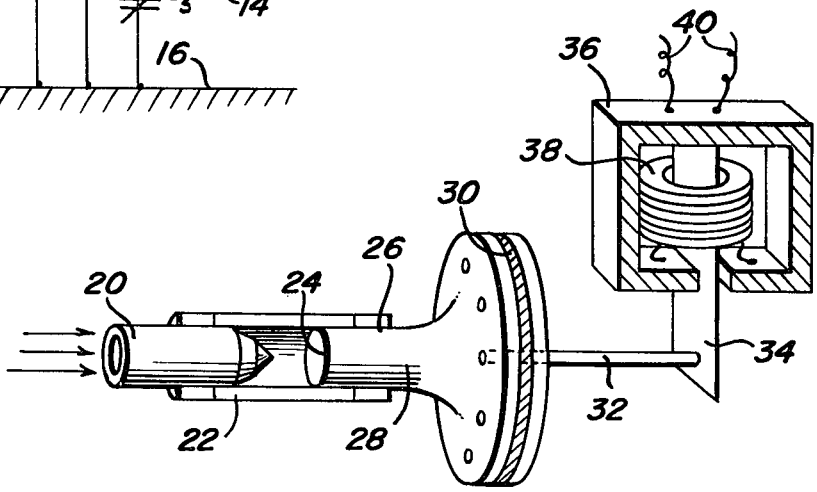
FIG. 2
FIG. 3
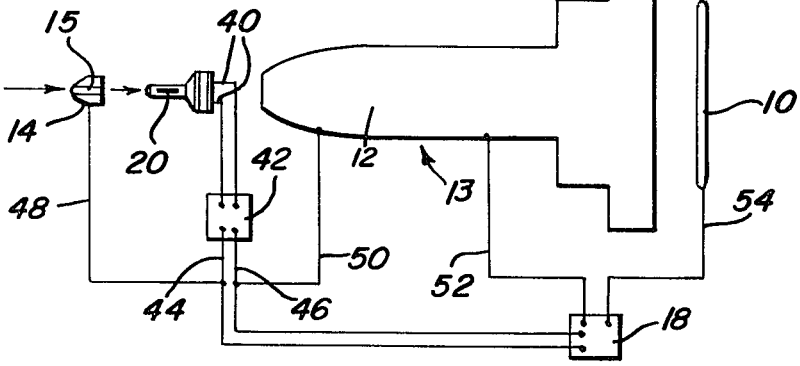

FLUIDIC CAPACITANCE DEVICE

RIGHTS OF THE GOVERNMENT

The invention described herein may be manufactured, used, and licensed by or for the United States Government for governmental purposes without the payment to us of any royalty thereon.

FIELD OF THE INVENTION

The present invention relates to ordinance fuzes, and more particularly to a fuze device having a fluidic generator which serves as a power supply and provides an input signal to a variable capacitance network made up of missle housing sections.

BRIEF DESCRIPTION OF THE PRIOR ART

In the past, a projectle housing has been constructed to contain various insolated conductive portions. The various conductive portions form a combination of capacitances that are connected together to form a sensitive bridge detector. The capacitances vary as the bomb approaches a large ground mass. Output signals from the bridge circuit will consequently vary until a trigger voltage level becomes manifest. This sets off the arming devices in the projectile.

Before the present invention, a D.C. power supply was contained within the projectile. The power supply was used to drive an A.C. oscillator that was impressed across the input of the capacitance bridge circuit. The output signal would change when the projectile approached a large ground mass so as to trigger the arming devices. Although the inclusion of a separate D.C. power supply proved satisfactory, it does result in additional components that add to the cost of the projectile fuze.

BRIEF DESCRIPTION OF THE PRESENT INVENTION

The transmitter for an A.C. capacitance proximity fuze consists of an A.C. generator whose output is directly connected to the transmitter probes of an A.C. capacitance fuze. The A.C. generator may be either a wind driven alternator or a fluid oscillator power supply driven by the ram pressure of the air. This arrangement eliminates the need for a separate oscillator now required for A.C. capacitance fuzes as the power supply is now also the transmitter. As will be appreciated, this simplification of hardware results in lower cost while maintaining equal or greater reliability.

BRIEF DESCRIPTION OF THE FIGURES

FIG. 1 is a schematic illustration illustrating the capacitive coupling configuration of the capacitance fuze.

FIG. 1*a* is a schematic illustration of an equivalent circuit for the various capacitors illustrated in FIG. 1.

FIG. 2 is a mechanical schematic illustration of a fluidic generator with a ringtone oscillator, which may be used in the present invention.

FIG. 3 is a schematic diagram of the electrical system associated with the present invention.

The present invention employs two prior art devices, which have not been previously combined. The first prior art device is a capacitance fuze which functions by sensing small changes in the external capacitive couplings between two electrodes. These couplings result when a high A.C. voltage is applied between certain housing portions of a projectile that are conductive in nature but electrically insulated from each other.

In the past, the high A.C. voltage was generated by a combination of a self contained D.C. power supply and an A.C. oscillator connected to the power supply. By virtue of the present invention, a second prior art device is utilized as an A.C. oscillator thus eliminating the need for a separate D.C. power supply. The A.C. oscillator takes the form of a fluidic generator which, may itself take various known alternative forms. It is the combination of the capacitance fuze and a fluidic generator which forms the basis of the present invention.

Referring to the figures, and more particularly FIG. 1 thereof, six capacitances are illustrated. More particularly, capacitances $C_1$, $C_2$, and $C_3$ are stray capacitances that result between various portions of a projectile housing and the ground plane — the target. A conductive receiver electrode 10 may take the form of a toroidal ring, properly fastened and insulated to the fin assembly 11 of the projectile 13. As indicated in FIG. 1, $C_1$ becomes manifest when stray capacitance develops between the receiver electrode 10 and the ground plane 16.

$C_2$ is again stray capacitance. It is the stray capacitance that exists between body 12 of the projectile 13 and the ground plane 16. The final variable capacitance is $C_3$ which exists between the transmitter electrode 14 and the ground plane 16.

$C_4$ is a fixed capacitance existing between the transmitter electrode 14 and the conductive body portion 12 of the projectile. $c_6$ is also a fixed capacitance, but exists between the receiver electrode 10 and the body 12. A third fixed capacitance $C_5$ does exist between the receiver electrode 10 and the transmitter electrode 14.

The equivalent circuit of the six capacitances described above is shown in FIG. 1*a*. The indicated input would be a high A.C. voltage so that the receiver signal, or output would likewise be an A.C. signal. The capacitance fuze, which is essentially a bridge circuit made up of fixed and variable stray capacitances, as seen in the equivalent circuit FIG. 1*a*, functions by sensing small changes in the external capacitive couplings between the receiver and transmitter electrodes. These couplings result when a high A.C. voltage is applied between the transmitter electrode and the body as shown in FIG. 1. Small changes in the capacitive values of these couplings occur when the device comes within the proximity of a target having a dielectric constant different from that of air. Otherwise stated, the capacitances $C_1$, $C_2$, and $C_3$ in FIG. 1 vary as the device approaches the ground plane. These changes are detected by a high gain receiver connected across $C_6$. The A.C. voltage input occurs across $C_4$. A receiver within housing 18 (FIG. 3) may ultimately trigger a SCR (not shown) and initiates a firing circuit in housing 18 (FIG. 3) when a predetermined percentage change at the capacitance fuze output has been obtained. The value of stray capacitances $C_1$, $C_2$, and $C_3$ are essentially zero when the projectile is far from the target. Thus, at the large distances, the capacitances have very little effect on the electronic circuitry of the receiver.

FIG. 2 is a schematic of a ringtone type fluidic generator. Air is introduced into the generator as shown in the Figure. The air thus flows from the annular orifice 20, through the oscillator tube 22 that connects the orifice 20 in communication with the annular edge 24 of the resonator cavity 26. This produces an acoustical oscillation in the connecting tube 22, known as a ringtone. The acoustical oscillation is then transmitted by the conical cavity 28 to a flexible diaphragm 30, which is caused to vibrate at its resonant frequency. The diaphragm 30 transmits its mechanical motion through connecting rod 32 to the reed 34 which is caused to flex between the poles of a permanent magnet 36. As the reed 34 alternately approaches and recedes from the poles of the magnet, the magnetic reluctance in the gap changes and a current is induced in the surrounding coil 38. It is in this manner that a relatively high voltage A.C. signal appears at the output wires 40.

FIG. 3 is a schematic of the overall system employed in the present invention. The transmitter electrode 14 has a small passageway 15 to admit ram air to the generator annular orifice 20. The output wires 40 from the fluidic generator are applied to a step-up transformer 42 to increase the A.C. voltage levels. Output leads 44 and 46 provide the A.C. power necessary to drive the receiver circuit in housing 18. Lead 48 is connected between the transmitter electrode 14 and the transformer lead 44. The connecting lead 50 is connected between the body 12 and the transformer lead 46. Connecting lead 52 is connected between the body 12 and the reciever and firing circuits in housing 18. The receiver electrode 10 has a connecting lead 54 connected between the receiver and firing circuits in housing 18 and the receiver electrode 10. As will be appreciated by viewing the overall system of FIG. 3, the inlet air is converted to electrical energy which is applied between the transmitter electrode 14 and the body 12. The electrical output of the generator is also used to power the receiver and firing circuits in housing 18. The leads 52 and 54 couple the fixed stray capacitance $C_6$ to the receiver input in housing 18.

Thus, as will be readily appreciated the present invention offers economies not previously realizable. This is due to the fact that the present invention directly couples an A.C. generator to the receiver and firing circuits.

It must be emphasized that although the present invention has been explained, in a preferred embodiment, as including a fluidic generator using a resonator cavity and diaphragm combination, other types of fluidic generators may be used. For example, a vane generator may be used. Basically, this type of generator includes a movable vane that responds to ram air. The output from the vane drives a generator. The vane type generator is prior art as is the disclosed generator. It is emphasized that the present invention resides in the combination of a fluidic generator and the capacitive coupling disclosed.

It should be understood that the invention is not limited to the exact details of contruction shown and described herein for obvious modifications will occur to persons skilled in the art.

Wherefore we claim the following:

1. A fluidic capacitance fuze for a projectile including a receiver, the fuze comprising:

a fluidic generator located in the projectile for generating an A.C. signal from ram air introduced into the projectile during flight;

first means connecting the fluidic generator to the receiver for providing bias power thereto;

second means connecting the A.C. signal between the projectile body and a transmitter electrode connected to and insulated from the body;

third means connected at respective first ends thereof to the body and a receiver electrode, the latter mounted to and insulated from the body, the receiver and transmitter electrodes also being mutually insulated from one another, the second ends of the third connecting means connected to the receiver input for providing an input A.C. signal to the receiver;

stray capacitances existing between the electrodes and the body, the capacitances varying substantially when the projectile approaches a target thereby causing the receiver input to change and effect a charge firing condition.

2. The structure of claim 1 together with means connected to the output of the fluidic generator for increasing the voltage level of the A.C. signal generated therefrom.

3. The subject matter of claim 1 wherein the transmitter electrode comprises:

an annular conductor positioned at the nose of the projectile for admitting ram air to the generator.

4. The subject matter of claim 2 wherein the transmitter electrode comprises:

an annular conductor positioned at the nose of the projectile for admitting ram air to the generator.

5. The subject matter of claim 1 wherein the fluidic generator comprises:

an annular orifice communicating with a resonator cavity via a connecting ringtone oscillator tube;

a diaphragm positioned in the cavity for producing mechanical vibrations in response to the ram air;

means connected between the diaphragm and a reed for translating the mechanical vibrations to a metallic reed positioned between the poles of a magnet;

means positioned between the poles of the magnet for generating an e.m.f. in response to mechanical oscillations of the reed; and output wires connected to the e.m.f. generating means for making an A.C. signal available thereat.

6. The subject matter of claim 4 wherein the fluidic generator comprises:

an annular orifice communicating with a resonator cavity via a connecting ringtone oscillator tube;

a diaphragm positioned in the cavity for producing mechanical vibrations in response to the ram air;

means connected between the diaphragm and a reed for translating the mechanical vibrations to a metallic reed positioned between the poles of a magnet;

means positioned between the poles of the magnet for generating an e.m.f. in response to mechanical oscillations of the reed; and output wires connected to the e.m.f. generating means for making an A.C. signal available thereat.

7. The subject matter of claim 1 wherein fixed stray capacitances exist between:

the receiver electrode and the body;

the body and the transmitter electrode; and the receiver electrode and the transmitter electrode.

8. The subject matter of claim 4 wherein fixed stray capacitances exist between:

the receiver electrode and the body;

the body and the transmitter electrode; and the receiver electrode and the transmitter electrode.

9. The subject matter of claim 1 wherein variable stray capacitances exist between:

the receiver electrode and a target;

the body and a target; and the transmitter electrode and a target.

10. The subject matter of claim 8 wherein variable stray capacitances exist between:

the receiver electrode and a target;

the body and a target; and the transmitter electrode and a target.

* * * * *